US005977856A

United States Patent [19]

Maekawa et al.

[11] Patent Number: 5,977,856

[45] Date of Patent: Nov. 2, 1999

[54] IGNITION COIL DEVICE FOR INTERNAL-COMBUSTION ENGINE

[75] Inventors: Toshio Maekawa; Mitsuru Koiwa, both of Tokyo, Japan

[73] Assignee: Mitsubishi Denki Kabushiki Kaisha, Tokyo, Japan

[21] Appl. No.: 08/990,783

[22] Filed: Dec. 15, 1997

[30] Foreign Application Priority Data

Oct. 7, 1997 [JP] Japan ..... 9-274686

[51] Int. Cl.[6] ..... H01F 27/02; F02P 15/00

[52] U.S. Cl. ..... 336/96; 336/92; 123/634

[58] Field of Search ..... 123/634; 336/96, 336/92, 107, 142, 143, 196, 198

[56] References Cited

U.S. PATENT DOCUMENTS

| | | | |
|---|---|---|---|
| 5,349,320 | 9/1994 | Suzuki et al. | 336/92 |
| 5,416,459 | 5/1995 | Ida et al. | 336/96 |
| 5,563,510 | 10/1996 | Gorrell et al. | 336/92 |
| 5,680,087 | 10/1997 | Sakata et al. | 336/96 |
| 5,703,556 | 12/1997 | Kikuta et al. | 336/96 |
| 5,781,092 | 7/1998 | Nakamachi et al. | 336/96 |
| 5,870,012 | 2/1999 | Sakamaki et al. | 336/107 |

FOREIGN PATENT DOCUMENTS 3-126030 12/1991 Japan .

*Primary Examiner*—Henry C. Yuen
*Assistant Examiner*—Jason Benton
*Attorney, Agent, or Firm*—Sughrue, Mion, Zinn, Macpeak & Seas, PLLC

[57] ABSTRACT

An ignition coil device for an internal-combustion engine reduces the deterioration in reliability caused by heat stress. The ignition coil device is provided with: a case (5); a core (6) provided in the case (5); a primary coil (8) which is provided so that it surrounds the core (6) and which has a primary winding (13) trough which a primary current flows composed of a conductor wound around a bottomed cylindrical primary bobbin (12); a secondary coil (9) which is provided so that it surrounds the primary coil (8) and in which high voltage is generated by the interruption of the primary current; a stopper (21) which is provided at an opening (12*a*) of the primary bobbin (12) to close the opening (12*a*) of the primary bobbin (12); and an insulator (11) composed of a thermosetting resin which is provided in the case (5) to secure the primary coil (8) and the secondary coil (9) in the case (5). The stopper (21) prevents the insulator (11), which has not yet been thermally cured, from flowing between the core (6) and the primary bobbin (12) when it is charged into the case (5).

16 Claims, 9 Drawing Sheets

IGNITION COIL DEVICE FOR INTERNAL-COMBUSTION ENGINE

BACKGROUND OF THE INVENTION

1. Field of the Invention

The present invention relates to an ignition coil device for an internal-combustion engine which has an open magnetic circuit structure.

2. Description of Related Art

FIG. 8 is a sectional view showing a conventional ignition coil device for an internal-combustion engine, and FIG. 9 is an enlarged view of an essential section of FIG. 8. The ignition coil device for an internal-combustion engine shown in the drawings is provided in a plug hole 4 formed by a cylinder head 1 and a cylinder head cover 3; it has a spark plug 2 inserted at the distal end thereof.

The ignition coil device for an internal-combustion engine is provided with: a bottomed cylindrical case 5; a columnar core 6 which extends along the center axis of the case 5 and which is composed of multiple layers of silicon steel plate strips; a primary coil 8 provided around the outer periphery of the core 6; a secondary coil 9 provided around the outer periphery of the primary coil 8, magnets 7 attached to both ends of the core 6 to prevent magnetic fluxes, which are generated in the primary coil 8, from saturating the core 6; a control circuit unit 10 which incorporates a power transistor (not shown) for controlling the supply of power to the primary coil 8 and which is provided above the core 6; a connector 19 having a terminal 18 electrically connected to the control circuit unit 10; and an insulator 11 composed of a thermosetting epoxy resin charged into the space in the case 5.

The primary coil 8 has a bottomed cylindrical primary bobbin 12 and a primary winding 13 constituted by a conductor wound around the primary bobbin 12. The secondary coil 9 has a bottomed cylindrical secondary bobbin 14 and a secondary winding 15 constituted by a conductor wound around the secondary bobbin 14.

In the aforesaid ignition coil device for an internal-combustion engine, the primary current supplied to the primary winding 13 of the primary coil 8 is interrupted by a signal from the control circuit unit 10 causing high voltage to be generated at the secondary winding 15. The high voltage is led to the spark plug 2 via a high-voltage terminal 16 and a spring 17 to cause a spark discharge at a gap 20.

In the conventional ignition coil device for an internal-combustion engine, the primary coil 8, the secondary coil 9, the core 6, and the control circuit unit 10 are disposed in the case 5, and the insulator 11, which is cured later, is charged into the case 5. After this, the insulator 11 is cured at a high temperature of about 130 degrees Celsius so as to secure the primary coil 8, the secondary coil 9, the core 6, and the control circuit unit 10 in the case 5. Hence, for example, during natural cooling after the heat curing, the force generated by the shrinkage of the insulator 11 is undesirably applied to the core 6 due to the difference in thermal expansion coefficients between the insulator 11 and the core 6, thus causing the core 6 to become distorted. This results in an increase of core loss which deteriorates the magnetic properties, and presents the problem of a lower output voltage of the ignition coil device for an internal-combustion engine.

Further, during the operation of a vehicle which incorporates this ignition coil device, the primary current flows into the primary winding 13, and the ignition coil device becomes heated due to the heat generated by the primary coil 8, the secondary coil 9, et., whereas it is subjected to natural cooling when operation is stopped. Thus, as the vehicle is repeatedly started and stopped, heat stress occurs mainly in the core 6, the insulator 11 placed between the core 6 and the primary coil 8, and the primary bobbin 12. As a result, cracks develop in components such as the insulator 11 and the primary bobbin 12, which in turn causes internal leakage and creates a problem in that, in the worst case, no output voltage is generated.

SUMMARY OF THE INVENTION

The present invention has been made with a view toward solving the problems mentioned above, and it is an object of the present invention to provide an ignition coil device for an internal-combustion engine, which is capable of preventing a deterioration in reliability caused primarily by the distortion of the core due to heat stress, or the occurrence of cracks in the primary bobbin or the secondary bobbin.

To this end, according to the present invention, there is provided an ignition coil device for an internal-combustion engine which is equipped with: a case, a core provided in this case, a primary coil which is provided such that it surrounds the core and which has a primary winding through which a primary current flows constituted by a conductor wound around a bottomed cylindrical primary bobbin; a secondary coil which is provided such that it surrounds the primary coil and in which high voltage is generated by the interruption of the primary current; a stopper provided at the opening of the primary bobbin to close the opening of the primary bobbin; and an insulator composed of a thermosetting resin which is provided in the case to secure the primary coil and the secondary coil in the case; wherein the stopper prevents the insulator, before it is thermally cured from flowing between the core and the primary bobbin when it is charged into the case.

In a preferred form of the ignition coil device for an internal-combustion engine, an insulative elastic member is provided between the core and the primary bobbin.

According to another aspect of the present invention, there is provided an ignition coil device for an internal-combustion engine, which is equipped with: a case, a core provided in the case, a primary coil which is provided such that it surrounds the core and which has a primary winding through which a primary current flows constituted by a conductor wound around a bottomed cylindrical primary bobbin; a secondary coil which is provided such that it surrounds the primary coil and in which high voltage is generated by the interruption of the primary current; and an insulative elastic member located between the core and the primary bobbin.

In a preferred form of the ignition coil device for an internal-combustion engine, the bottom surface of the primary bobbin has an aperture closed with a cover.

In another preferred form of the ignition coil device for an internal-combustion engine, the cover is provided with a positioning section for positioning the core.

In a further preferred form of the ignition coil device for an internal-combustion engine, cross sections of the core and the primary bobbin obtained by cutting them perpendicularly to the axis of the core have similar shapes.

According to yet another aspect of the present invention, there is provided an ignition coil device for an internal-combustion engine, which is equipped with: a case, a core provided in this case, a primary coil which is provided such that it surrounds the core and which has a primary winding through which a primary current flows; a secondary coil which is provided between the primary coil and the core such that it surrounds the core and which has a secondary winding composed of a conductor wound around a bottomed cylindrical secondary bobbin, high voltage being generated in the secondary winding by the interruption of the primary current; a stopper provided at the opening of the secondary bobbin to close the opening of the secondary bobbin; and an insulator composed of a thermosetting resin which is provided in the case to secure the primary coil and the secondary coil in the case; wherein the stopper prevents the insulator, which has not yet been thermally cured, from flowing between the core and the secondary bobbin when it is charged into the case.

In a preferred form of the ignition coil device for an internal-combustion engine, there is an insulative elastic member between the core and the secondary bobbin.

According to a further aspect of the present invention, there is provided an ignition coil device for an internal-combustion, which is equipped with: a case, a core provided in the case, a primary coil which is provided such that it surrounds the core and which is composed of a primary winding through which a primary current flows; a secondary coil which is provided between the primary coil and the core such that it surrounds the core and has a secondary winding composed of a conductor wound around a bottomed cylindrical secondary bobbin, high voltage being generated in the secondary winding by the interruption of the primary current; and an insulative elastic member located between the core and the secondary bobbin.

In a further preferred form of the ignition coil device for an internal-combustion engine, cross sections of the core and the secondary bobbin obtained by cutting them perpendicularly to the axis of the core have similar shapes.

In a further preferred form of the ignition coil device for an internal-combustion engine, the stopper is provided with a space for receiving the thermally expanded insulative elastic member.

According to a further aspect of the present invention, there is provided an ignition coil device for an internal-combustion, which is equipped with: a case, a core provided in the case, a primary coil which is provided such that it surrounds the core and which has a primary winding through which primary current flows; a secondary coil which is provided between the primary coil and the core such that it surrounds the core and which has a secondary winding composed of a conductor wound around a bottomed cylindrical secondary bobbin, high voltage being generated in the secondary winding by the interruption of the primary current; an insulative partition which extends along the axis of the core from the bottom surface of the secondary bobbin and which separates the core and the secondary bobbin; a stopper provided at the opening of the partition to close the opening; and an insulator composed of a thermosetting resin which is provided in the case to secure the primary coil and the secondary coil in the case; wherein the stopper prevents the insulative member, which has not yet been thermally cured, from flowing between the core and the partition when it is charged into the case.

In a preferred form of the ignition coil device for an internal-combustion engine, the partition is composed of a very tough elastic material.

In a preferred form of the ignition coil device for an internal-combustion engine, the bottom surface of the secondary bobbin has an aperture closed with a cover.

In a further preferred form of the ignition coil device for an internal-combustion engine, the cover is provided with a positioning portion for positioning the core.

In a further preferred form of the ignition coil device for an internal-combustion engine, the insulator is composed of epoxy resin.

In a yet further preferred form of the ignition coil device for an internal-combustion engine, the core is composed of a silicon steel plate, which is a directional electromagnetic steel plate.

In a further preferred form of the ignition coil device for an internal-combustion engine, at least a part of each of the case, the core, the primary coil, and the secondary coil is placed in a plug hole accommodating a spark plug.

DESCRIPTION OF THE PREFERRED EMBODIMENTS

First Embodiment

Figure 1:
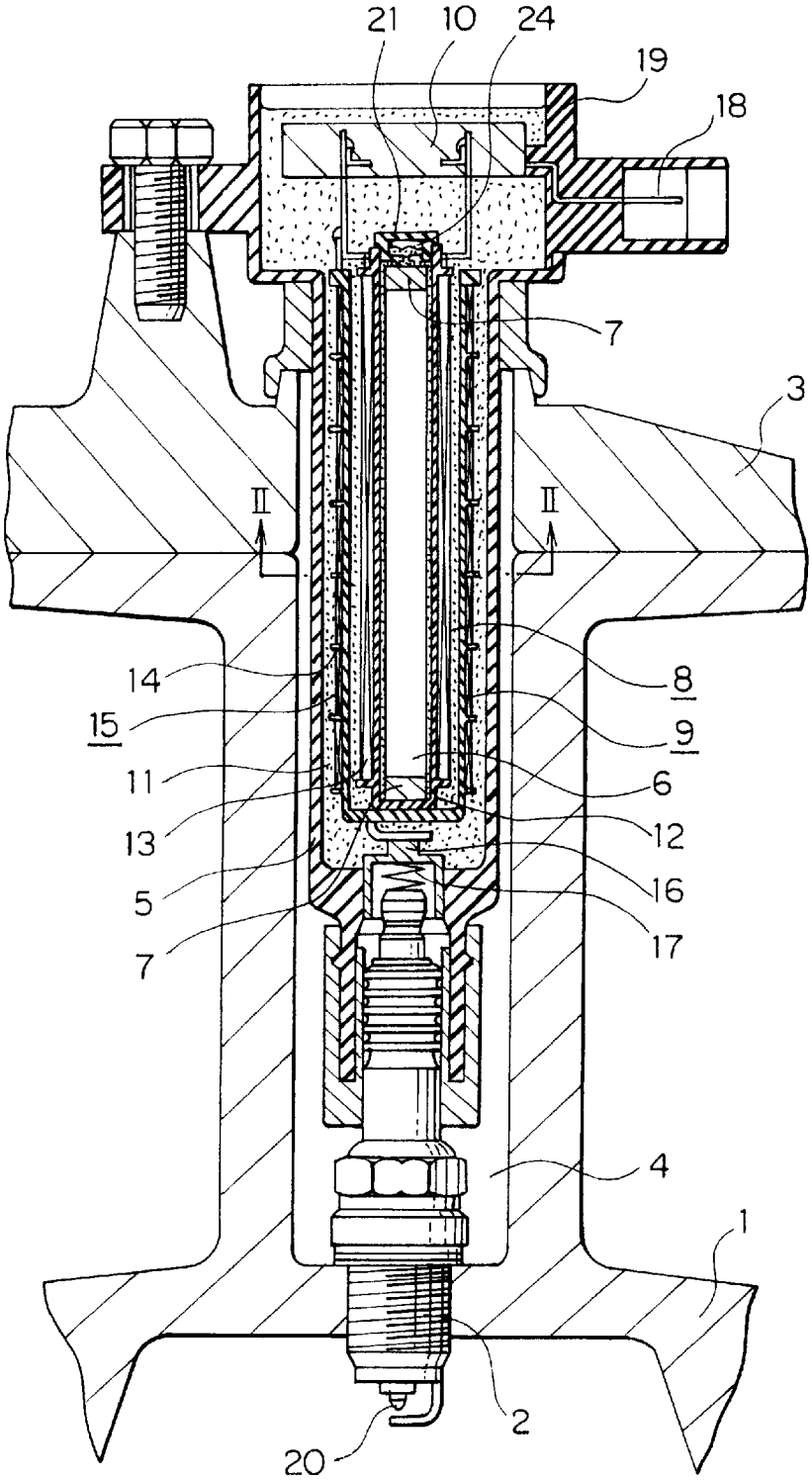
FIG. 1 is a sectional side elevation illustrative of a first embodiment in accordance with the present invention.
Figure 2:
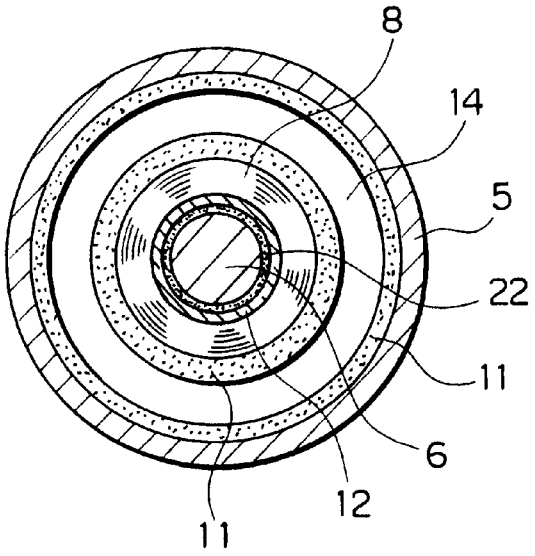
FIG. 2 is a sectional view at the line II—II of FIG. 1.
Figure 3:
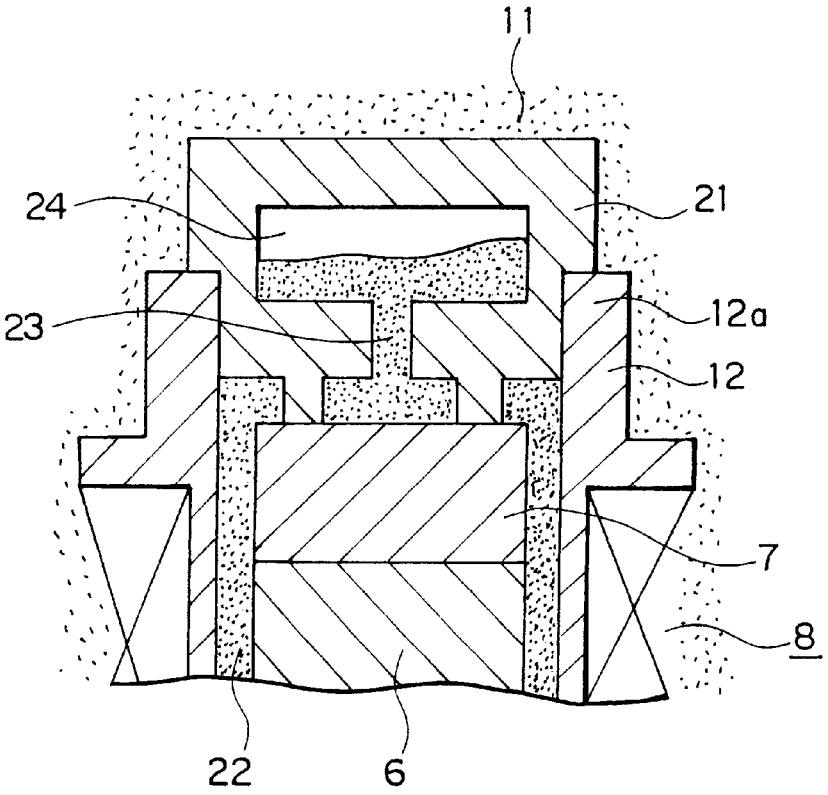
FIG. 3 is an enlarged view illustrative of an essential section of FIG. 1.

FIG. 1 is a sectional side elevation illustrative of an ignition coil device for an internal-combustion engine of a first embodiment in accordance with the present invention; FIG. 2 is a sectional view taken at the line II—II of FIG. 1; and FIG. 3 is an enlarged view illustrative of an essential section of FIG. 1.

The ignition coil device for an internal-combustion engine is provided in a plug hole 4 formed by a cylinder head 1 and a cylinder head cover 3; it has a plug 2 inserted at the distal end thereof.

The ignition coil device for an internal-combustion engine is provided with: a bottomed cylindrical case 5; a columnar core 6, which extends along the center axis of the case 5 and is composed of multiple layers of silicon steel plate strips; a primary coil 8 provided around the outer periphery of the core 6; a secondary coil 9 provided around the outer periphery of the primary coil 8, magnets 7 attached to both ends of the core 6 to prevent magnetic fluxes, which are generated in the primary coil 8, from saturating the core 6; a control circuit unit 10 which is provided above the core 6 and which incorporates a power transistor (not shown) for controlling the supply of power to the primary coil 8; a connector 19 having a terminal 18 electrically connected to the control circuit unit 10; an insulator 11 composed of a thermosetting epoxy resin charged into the case 5; a stopper 21 composed of an elastic member which is provided at the top end of the primary coil 8; and an insulative elastic member 22 composed of silicone resin which is installed between the core 6 and the primary coil 8.

The primary coil 8 has a bottomed cylindrical primary bobbin 12 and a primary winding 13 constituted by a conductor wound around the primary bobbin 12. The secondary coil 9 has a bottomed cylindrical secondary bobbin 14 and a secondary winding 15 constituted by a conductor wound around the secondary bobbin 14.

A space 24 is formed inside the stopper 21 inserted in an opening 12*a* of the primary bobbin 12 which is communicated to the outer peripheral section of the core 6 through an aperture 23.

The insulative elastic member 22 bonds the core 6 and the primary bobbin 12 to secure the core 6 in the primary bobbin 12 so as to prevent the core 6, which is excited when primary current flows through the primary winding 13, from vibrating.

The core 6 is composed of a silicon steel plate, which is a directional electromagnetic steel plate, to enhance the excitation efficiency of the core 6.

In the case of the foregoing ignition coil device for an internal-combustion engine, the primary coil 8, the secondary coil 9, the core 6, and the control circuit unit 10 are disposed in the case 5, and the insulative elastic member 22 composed of silicone resin is charged between the core 6 and the primary bobbin 12. After that, the opening 12*a* of the primary bobbin 12 is closed with the stopper 21, then the insulator 11, which has not yet been cured, is charged into the case 5. The insulator 11 is cured at a high temperature of about 130 degrees Celsius so as to secure the primary coil 8, the secondary coil 9, the core 6, and the control circuit unit 10 in the case 5.

In the aforesaid ignition coil device for an internal-combustion engine, the primary current supplied to the primary winding 13 of the primary coil 8 is interrupted by a signal supplied from the control circuit unit 10, and high voltage is generated at the secondary winding 15. The high voltage is led to the spark plug 2 via a high-voltage terminal 16 and a spring 17 to cause a spark discharge at a gap 20.

In this embodiment, the insulator 11, which strongly contributes to the occurrence of heat stress in the core 6 and the primary bobbin 12 is not interposed between the core 6 and the primary bobbin 12; instead, the insulative elastic member 22 is allowed to thermally expand in the space 24 through the aperture 23, thus reducing the occurrence of heat stress in the core 6 and the primary bobbin 12.

In the aforesaid embodiment, the insulative elastic member 22 is present in the entire space between the core 6 and the primary bobbin 12; however, the insulative elastic member may alternatively be provided in just a part of the space as long as it is able to prevent the core 6 from vibrating when it is excited.

As another alternative, a block-shaped stopper may be used to firmly press the core against the bottom surface of the primary bobbin to fix the core in the primary bobbin, thus making it possible to obviate the need for the insulative elastic member between the core and the bobbin.

When the insulative elastic member 22 is provided so that it fills up the entire space between the core 6 and the primary bobbin 12, the insulator 11 is not charged between the core 6 and the primary bobbin 12, thus eliminating the need for the stopper 21. In this case, the space 24 for accommodating the thermally expanded insulative elastic member 22 is absent as compared with the foregoing embodiment; however, the occurrence of heat stress in the core 6 and the primary bobbin 12 is reduced as compared with the conventional one with the insulator 11.

Providing the space 24 with a vent pipe for communicating with the outside air enables the insulative elastic member 22 to easily expand in the space 24, thus making it possible to further reliably reduce the heat stress which occurs in the core 6 and the primary bobbin 12.

Further, all the core 6, the primary bobbin 12, and the secondary bobbin 14 have circular cross-sections, and the core 6, the primary bobbin 12, and the secondary bobbin 14 all have similar figures. This makes it possible to prevent heat stress from being locally concentrated when they expand and contract due to heat. The cross-sections of the foregoing components may be of another shape, e.g. square, as long as they have similar shapes.

Second Embodiment

Figure 4:
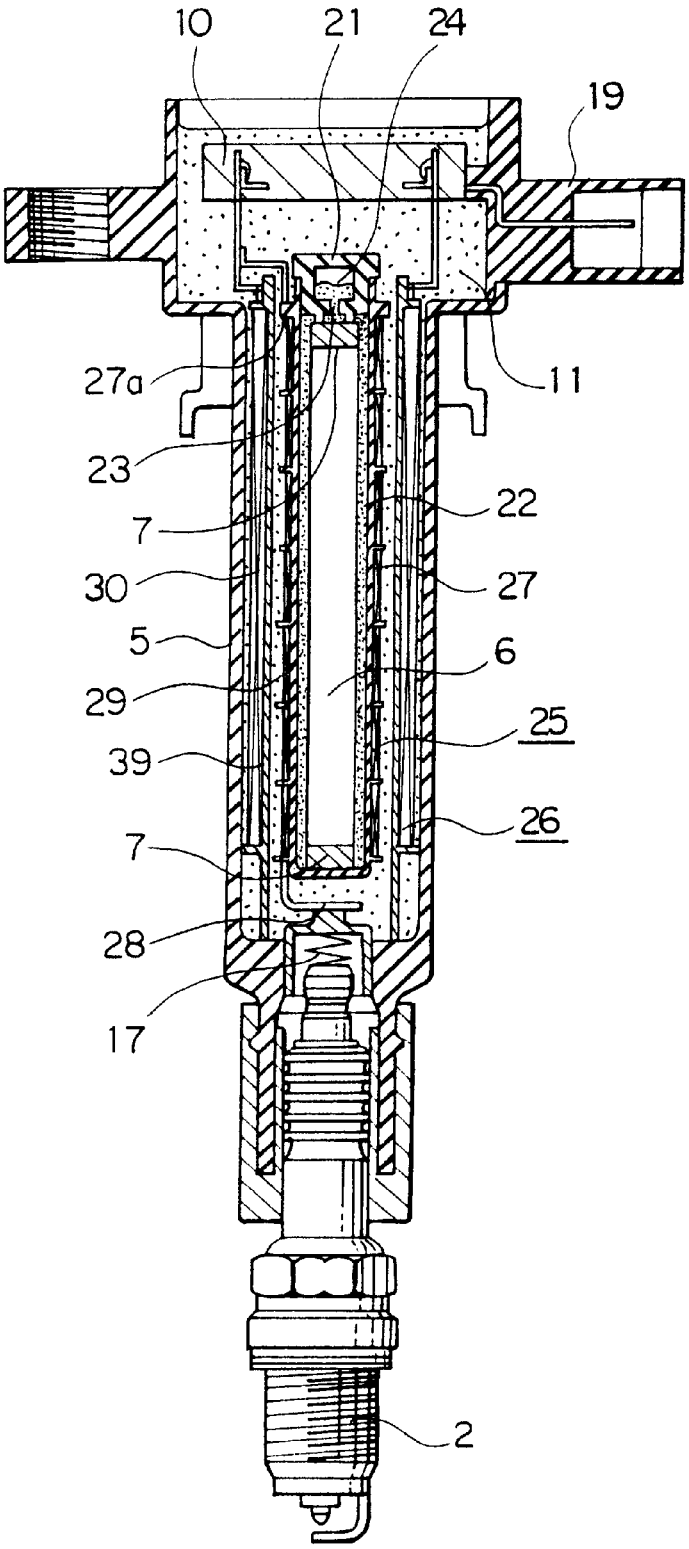
FIG. 4 is a sectional side elevation illustrative of a second embodiment in accordance with the present invention.

FIG. 4 is a sectional side elevation illustrative of a second embodiment. A secondary coil 25 is disposed such that it surrounds the core 6, and a primary coil 26 is disposed such that it surrounds the secondary coil 25. The secondary coil 25 has a bottomed cylindrical secondary bobbin 27 and a secondary winding 29 composed of a conductor wound around the secondary bobbin 27. The stopper 21, similar to that in the first embodiment, is inserted in an opening 27*a* of the secondary bobbin 27. The primary coil 26 has a primary bobbin 39 and a primary winding 30 composed of a conductor wound around the primary bobbin 39.

As in the case of the first embodiment, the insulative elastic member 22 is provided between the core 6 and the secondary bobbin 27 in order to protect the secondary bobbin 27 from dielectric breakdown attributable to a corona discharge produced between the core 6 and the secondary bobbin 27 due to the presence of an air layer between the core 6 and the secondary bobbin 27.

The rest of the configuration of the second embodiment is identical to the configuration of the first embodiment.

In general, the secondary bobbin of the secondary coil, wherein a high voltage of a few tens of kilovolts are generated, employs an amorphous resin such as modified polyphenylene-oxide (PPO), which exhibits good adhesiveness to epoxy resin which is the material for the insulator, so as to strengthen the bonding between the secondary bobbin and the insulator. On the other hand, the primary bobbin of the primary coil, wherein a low voltage of a few hundred volts are generated, employs a crystalline resin such as polybutylene terephthalate (PBT) which, while inexpensive and exhibiting good moldability, does not have very good adhesiveness to epoxy resin. The amorphous resin used for the secondary bobbin has a lower level of toughness than the crystalline resin and tends to develop cracks from heat stress. Hence, it is difficult to dispose the secondary bobbin, which is prone to cracks, on the side of the core where a high level of heat stress tends to occur because the core and the insulator, which have considerably different thermal expansion coefficients, are located side by side.

In this embodiment, the insulative elastic member 22, which is allowed to thermally expand in the space 24 through the aperture 23, is provided between the core 6 and the secondary bobbin 27 in place of the insulator 11 which has a greatly different thermal expansion coefficient from that of the core 6. Hence, even when the secondary coil 25 is disposed inside the primary coil 26, the secondary bobbin 27 is not prone to cracks attributable to the heat stress in the core 6.

Thus, since it becomes possible to provide the secondary coil 25 inside the primary coil 26, the distance between the secondary coil 25 and a high-voltage terminal 28 providing a connection to the spark plug 2 on the axis of the core 6 can be shortened, thus allowing the leakage of high voltage from the high voltage terminal 28 to be prevented, with resultant improved reliability. Moreover, since the winding diameter of the secondary winding 29 is reduced, the lead wire diameter is smaller than that of the primary winding 30, so that the overall length of the costly secondary winding 29 is shortened, thus permitting lower material cost. In addition, the number of turns of the secondary winding 29 is approximately one hundred times that of the primary winding 30, since the winding diameter of the secondary winding 29 is reduced, the speed of winding the conductor onto the secondary bobbin 27 can be increased, permitting the time required to wind the conductor of the secondary winding 29 to be reduced.

Further, under a condition where no corona discharge takes place between the core and the secondary bobbin, a block-shaped stopper may be used to firmly press the core against the bottom surface of the secondary bobbin to secure the core in the secondary bobbin, thus eliminating the need for the insulative elastic member to be provided between the core and the secondary bobbin.

When the insulative elastic member 22 is provided in the entire space between the core 6 and the secondary bobbin 27, the insulator 11 is not charged between the core 6 and the secondary bobbin 27, thus eliminating the need for the stopper 21. In this case, although the space 24 for accommodating the thermally expanded insulative elastic member 22 is not provided as compared with the aforesaid embodiment, the occurrence of heat stress in the core 6 and the secondary bobbin 27 is reduced as compared with the conventional one having the insulator 11.

Third Embodiment

Figure 5:
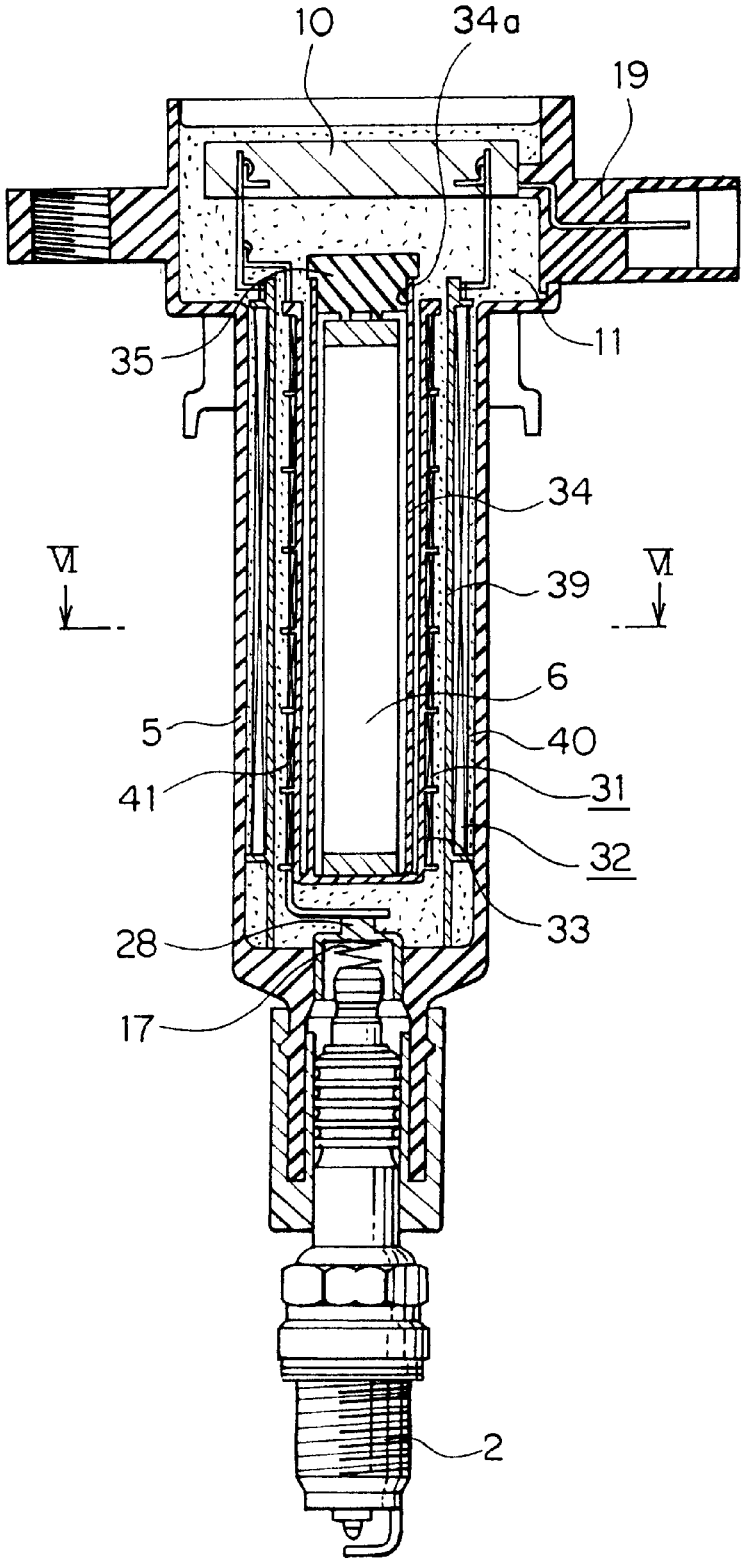
FIG. 5 is a sectional side elevation illustrative of a third embodiment in accordance with the present invention.
Figure 6:
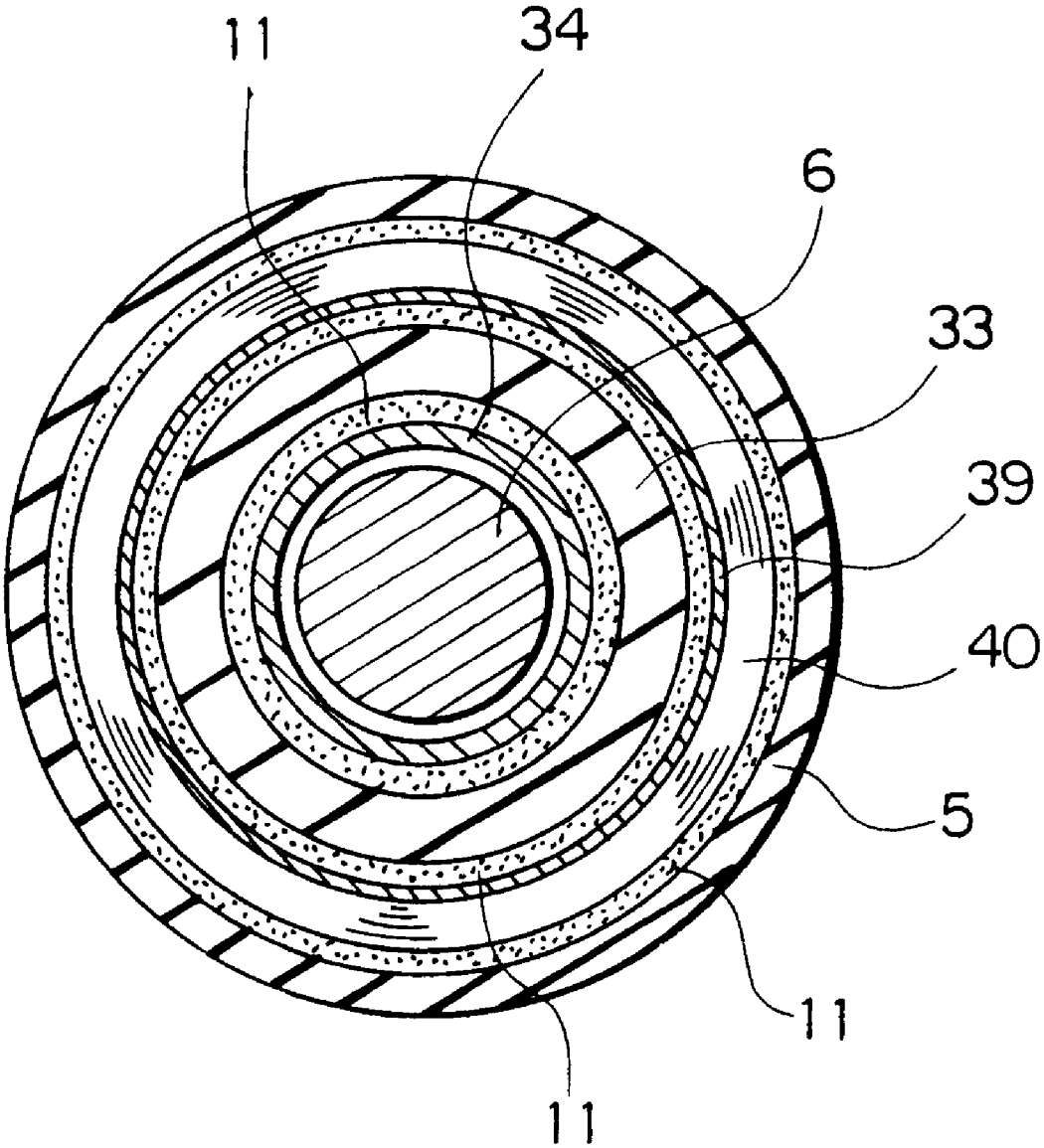
FIG. 6 is a sectional side elevation at the line VI—IV of FIG. 5.

FIG. 5 is a sectional view illustrative of the ignition coil device for an internal-combustion engine of a third embodiment in accordance with the present invention and FIG. 6 is a sectional view at the line VI—VI of FIG. 5.

In this embodiment, a secondary coil 31 which has a secondary winding 41 wound around a secondary bobbin 33 is disposed such that it surrounds the core 6, and a primary coil 32 which has a primary winding 40 wound around a primary bobbin 39 is disposed such that it surrounds the secondary coil 31 as in the second embodiment. A cylindrical partition 34 which extends along the axis of the secondary bobbin 33 is provided inside the bottomed cylindrical secondary bobbin 33. A stopper 35 composed of an elastic member is inserted in an opening 34*a* of the partition 34. The stopper 35 firmly presses the core 6 against the bottom surface of the secondary bobbin 33 to prevent the core 6 from vibrating when it is excited by the primary current flowing through the primary winding 40.

The rest of the configuration of the third embodiment is identical to the configuration of the first embodiment.

In the second embodiment, the insulative elastic member 22 is provided between the core 6 and the secondary bobbin 27 to protect the secondary bobbin 27 from dielectric breakdown caused by the corona discharge that takes place between the core 6 and the secondary bobbin 27. In the third embodiment, the partition 34 is provided between the core 6 and the secondary bobbin 33, so that the dielectric breakdown of the secondary bobbin 33 caused by the corona discharge between the core 6 and the secondary bobbin 33 can be prevented without providing the insulative elastic member 22.

In the aforesaid embodiment, the secondary bobbin 33 and the partition 34 are formed integrally, employing a highly tough material such as crystalline resin, this makes it possible to more reliably prevent the occurrence of cracks in the partition.

Fourth Embodiment

Figure 7A:
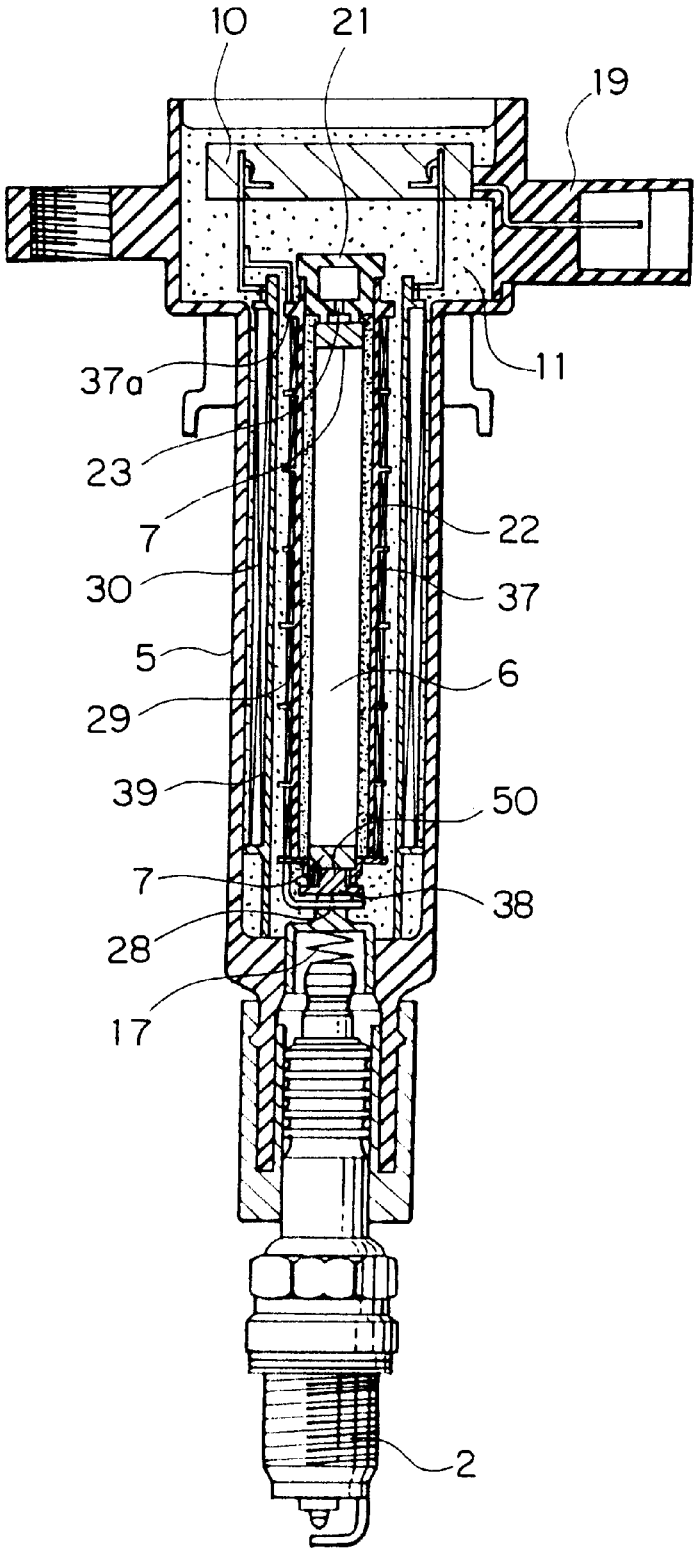
FIG. 7A and FIG. 7B are sectional side elevations illustrative of a fourth embodiment in accordance with the present invention.

FIG. 7A is a sectional view showing the ignition coil device for an internal-combustion engine of a fourth embodiment in accordance with the present invention. In the fourth embodiment, the aperture formed in the bottom surface of a secondary bobbin 37 is closed by a cover 38; this is different from the secondary bobbin 27 of the second embodiment illustrated in FIG. 4. The rest of the configuration of the fourth embodiment is the same as the configuration of the second embodiment.

The cylindrical secondary bobbin 37 of this embodiment has an opening 37*a* at one end and an aperture at the other end; hence, a cylindrical metal mold for forming the internal surface of the secondary bobbin 37 permits both ends of the metal mold to be supported at the time of forming the secondary bobbin 37. This enables the metal mold to be securely positioned on the center line of the secondary bobbin 37, thus making it possible to easily obtain the secondary bobbin 37 having an even wall thickness.

Further, equal spacing can be secured between the core 6 and the secondary bobbin 37 by forming a protuberance 50, which serves as a positioning portion, at the center of the surface of the cover 38 and by engaging the protuberance 50 with a recessed section (not shown) formed at the center of the magnet 7.

Figure 7B:
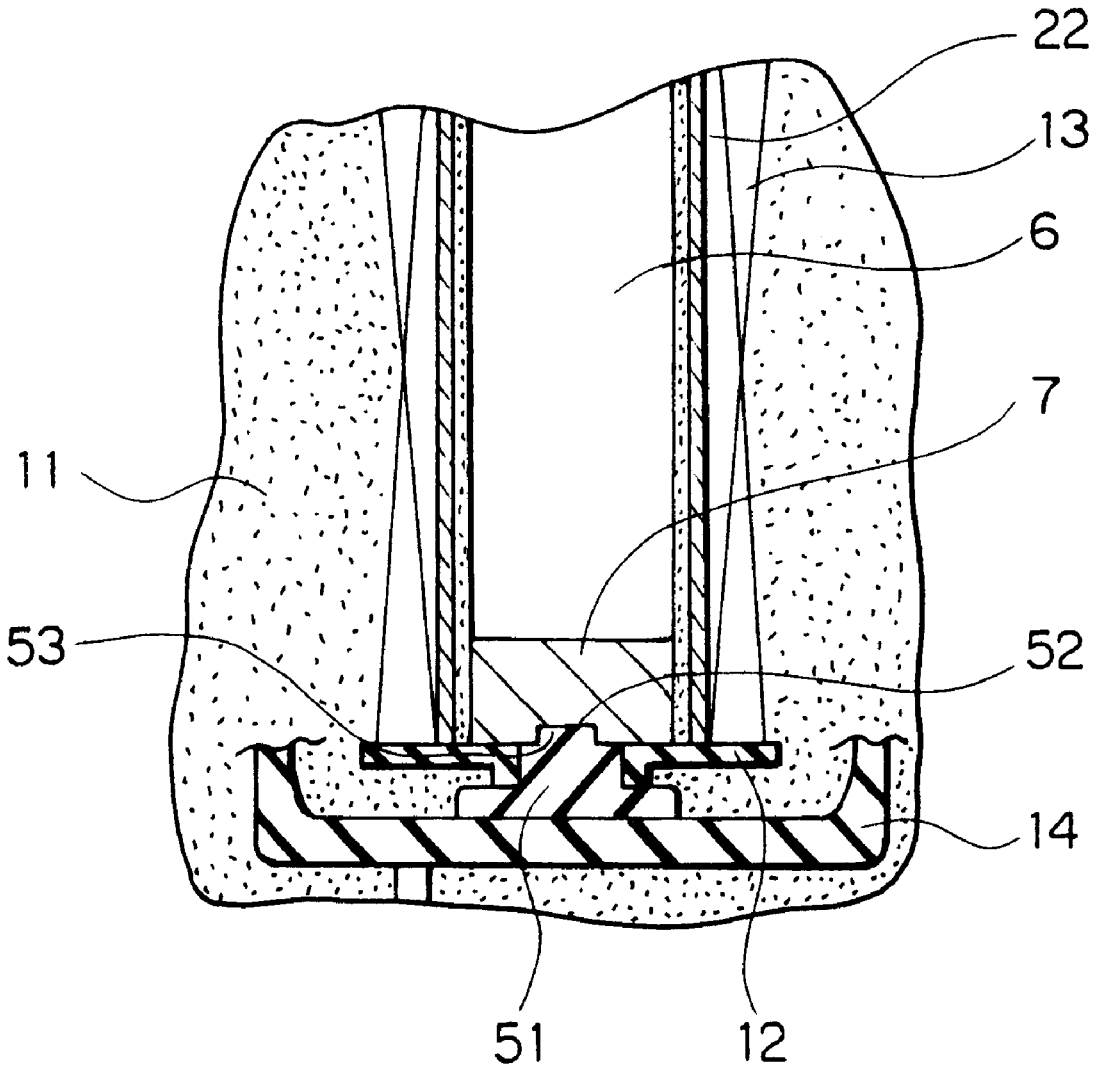
Figure 8:
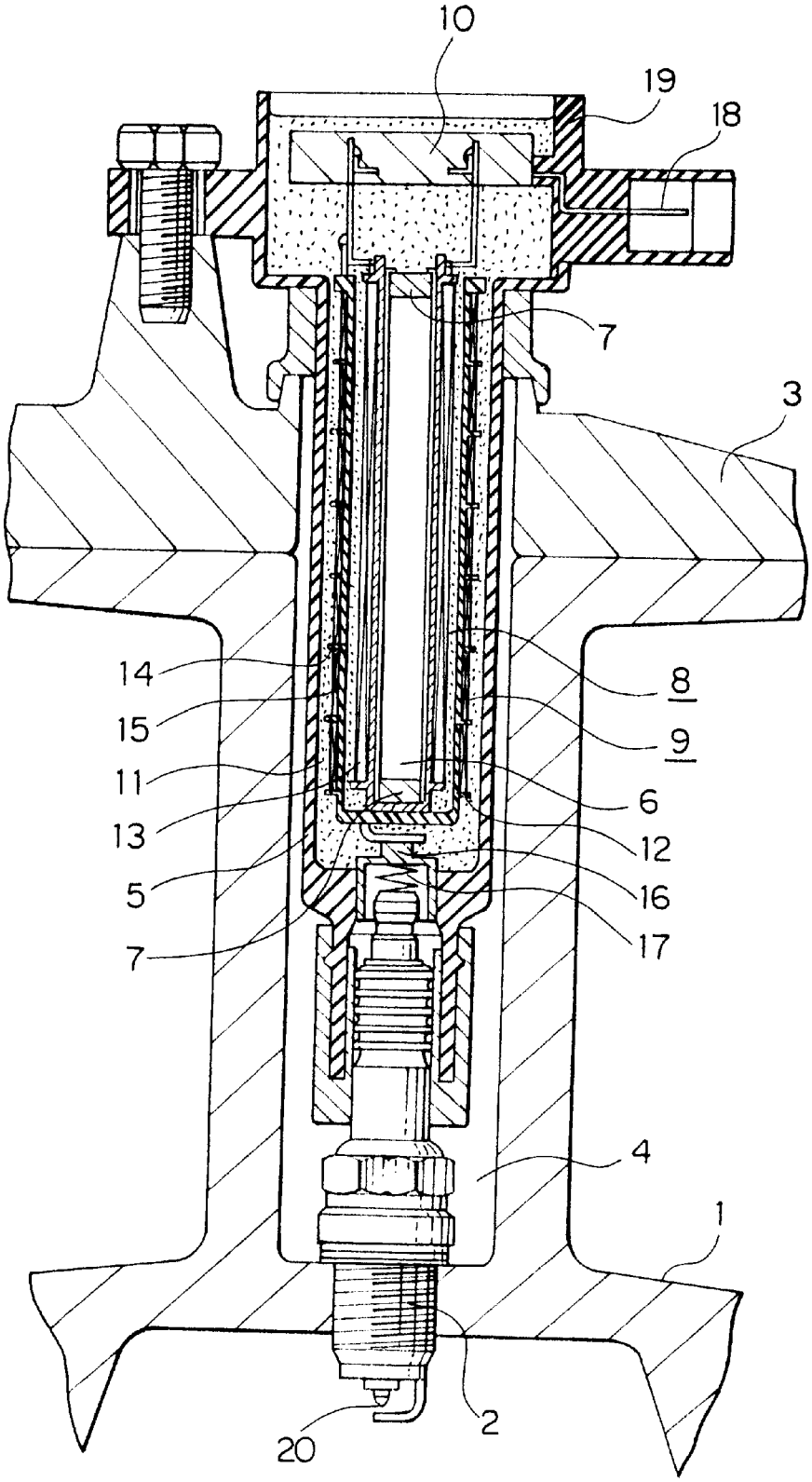
FIG. 8 is a sectional side elevation illustrative of a conventional ignition coil device for an internal-combustion engine.
Figure 9:
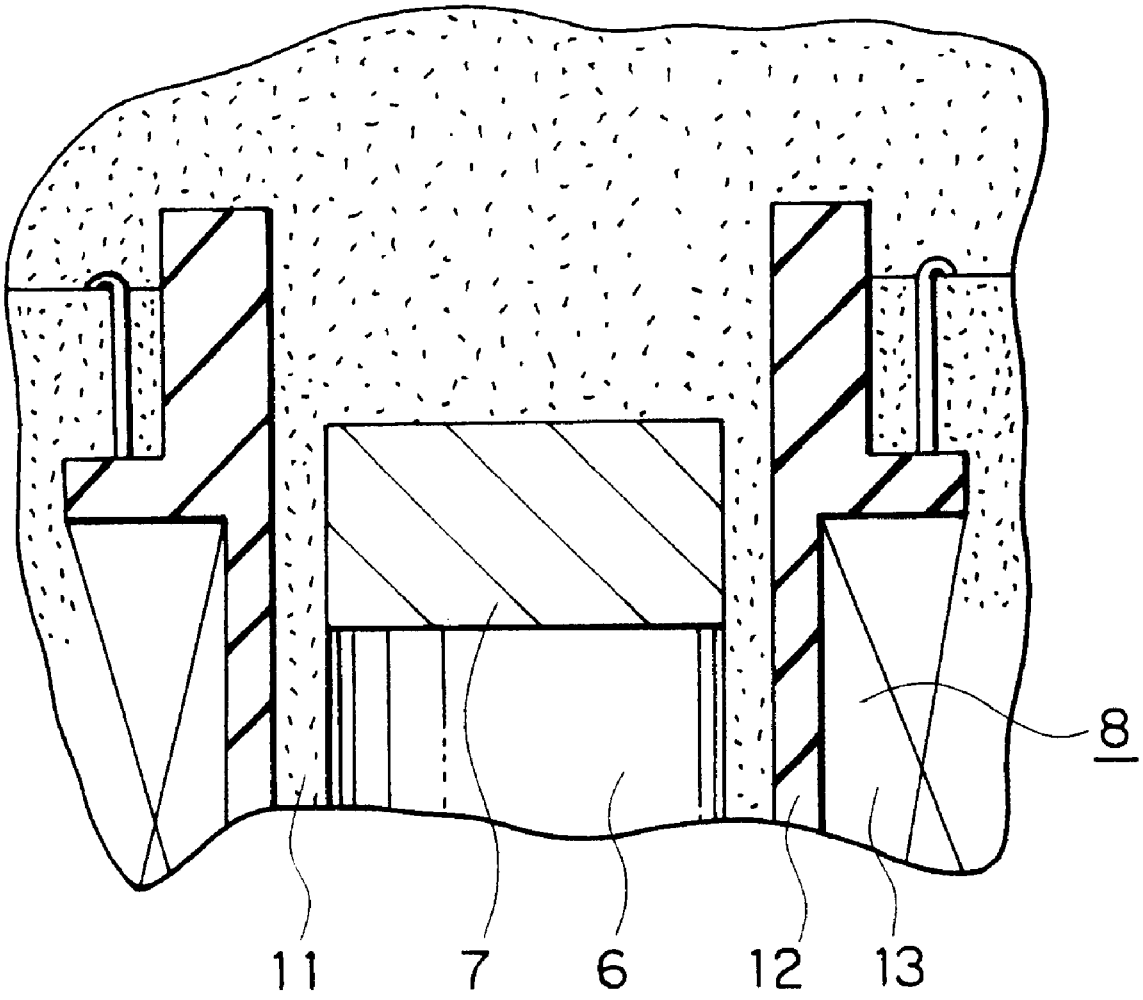
FIG. 9 is an enlarged view of an essential section of FIG. 8.

The primary bobbin 12 in the first embodiment can be formed to have a uniform wall thickness by forming an aperture in the bottom surface thereof as shown in FIG. 7B and by covering the aperture with a cover 51.

Furthermore, equal spacing can be secured between the core 6 and the primary bobbin 12 by forming a protuberance 52, which serves as a positioning portion, at the center of the surface of the cover 51 and by engaging the protuberance 52 with a recessed section 53 formed at the center of the magnet 7.

All the embodiments explained above have referred to the ignition coil device for an internal-combustion engine which controls the supply of the primary current by employing a power transistor. However, the present invention can also be applied to an ignition coil device for an internal combustion engine which employs, for example, a thyristor.

Thus, the ignition coil device for an internal-combustion engine in accordance with the present invention is equipped with: a case, a core provided in this case, a primary coil which is provided such that it surrounds the core and has a primary winding through which a primary current flows constituted by a conductor wound around a bottomed cylindrical primary bobbin; a secondary coil which is provided such that it surrounds the primary coil and in which high voltage is generated by the interruption of the primary current; a stopper provided at the opening of the primary bobbin to close the opening of the primary bobbin; and an insulator composed of a thermosetting resin which is provided in the case to secure the primary coil and the secondary coil in the case; wherein the stopper prevents the insulator, which has not yet been thermally cured, from flowing between the core and the primary bobbin when it is charged into the case. Accordingly, an insulator which has a considerably different thermal expansion coefficient from that of the core is absent between the core and the primary bobbin. This permits the prevention of problems including the occurrence of cracks in the insulator and/or the primary bobbin, and the distortion of the core attributable to heat stress, so that higher reliability can be achieved.

Further, in the ignition coil device for an internal-combustion engine, an insulative elastic member is provided between the core and the primary bobbin. This permits the prevention of problems including the occurrence of cracks in the insulator and/or the primary bobbin, and distortion of the core attributable to heat stress, so that higher reliability can be achieved.

The ignition coil device for an internal-combustion engine in accordance with the present invention is equipped with: a case, a core provided in the case, a primary coil which is provided such that it surrounds the core and which has a primary winding through which a primary current flows constituted by a conductor wound around a bottomed cylindrical primary bobbin; a secondary coil which is provided such that it surrounds the primary coil and in which high voltage is generated by the interruption of the primary current; and an insulative elastic member located between the core and the primary bobbin. This permits the prevention of problems including the occurrence of cracks in the insulator and/or the primary bobbin, and distortion of the core attributable to heat stress, so that higher reliability can be achieved.

Furthermore, in the ignition coil device for an internal-combustion engine, the bottom surface of the primary bobbin has an aperture closed with a cover. Hence, both ends of the metal mold for forming the internal surface of the primary bobbin can be supported at the time of forming the primary bobbin by injection molding. This enables the metal mold to be securely positioned on the center line of the primary bobbin, thus making it possible to easily obtain a primary bobbin having an even wall thickness.

In the ignition coil device for an internal-combustion engine, the cover is provided with a positioning section for positioning the core; hence, an even gap can be reliably obtained between the primary bobbin and the core.

In the ignition coil device for an internal-combustion engine, the cross-sections of the core and the primary bobbin obtained by cutting them perpendicularly to the axis of the core have similar shapes. This makes it possible to prevent heat stress from being locally concentrated in the core and the primary bobbin when they expand or contract due to heat.

Furthermore, in another embodiment of the ignition coil device for an internal-combustion engine is equipped with: a case, a core provided in this case, a primary coil which is provided such that it surrounds the core and which has a primary winding through which a primary current flows; a secondary coil which is provided between the primary coil and the core such that it surrounds the core and has a secondary winding composed of a conductor wound around a bottomed cylindrical secondary bobbin, high voltage being generated in the secondary winding by the interruption of the primary current; a stopper provided at the opening of the secondary bobbin to close the opening of the secondary bobbin; and an insulator composed of a thermosetting resin which is provided in the case to secure the primary coil and the secondary coil in the case; wherein the stopper prevents the insulator, which has not yet been thermally cured, from flowing between the core and the secondary bobbin when it is charged into the case. Accordingly, an insulator which has a considerably different thermal expansion coefficient from that of the core is not present between the core and the secondary bobbin. This permits the prevention of problems including the occurrence of cracks in the insulator and/or the secondary bobbin, and the distortion of the core attributable to heat stress, so that higher reliability can be achieved.

In the ignition coil device for an internal-combustion engine, there is an insulative elastic member between the core and the secondary bobbin. This permits the prevention of problems including the occurrence of cracks in the insulator and/or the secondary bobbin, and the distortion of the core attributable to heat stress, so that higher reliability can be achieved.

In a further embodiment, the ignition coil device for an internal-combustion is equipped with: a case, a core provided in the case, a primary coil which is provided such that it surrounds the core and which has a primary winding through which a primary current flows; a secondary coil which is provided between the primary coil and the core such that it surrounds the core and has a secondary winding composed of a conductor wound around a bottomed cylindrical secondary bobbin, high voltage being generated in the secondary winding by the interruption of the primary current; and an insulative elastic member located between the core and the secondary bobbin. This permits the prevention of problems including the occurrence of cracks in the insulator and/or the secondary bobbin, and the distortion of the core attributable to heat stress, so that higher reliability can be achieved.

In the ignition coil device for an internal-combustion engine, the cross-sections of the core and the secondary bobbin obtained by cutting them perpendicularly to the axis of the core have similar shapes. This makes it possible to prevent heat stress from being locally concentrated in the core and the secondary bobbin when they expand or contract due to heat.

In the ignition coil device for an internal-combustion engine, the thermally expanded insulative elastic member is received in the space. This permits the prevention of the occurrence of cracks in the core, the primary bobbin and/or the secondary bobbin, and the distortion of the core attributable to the expansion of the insulative elastic member, so that higher reliability can be achieved.

The ignition coil device for an internal-combustion according to a further aspect of the present invention is equipped with: a case, a core provided in the case, a primary coil which is provided such that it surrounds the core and which is composed of a primary winding through which a primary current flows; a secondary coil which is provided between the primary coil and the core such that it surrounds the core and which has a secondary winding of a conductor wound around a bottomed cylindrical secondary bobbin, high voltage being generated in the secondary winding by the interruption of the primary current; an insulative partition which extends along the axis of the core from the bottom surface of the secondary bobbin and separates the core and the secondary bobbin; a stopper provided at the opening of the partition to close the opening; and an insulator composed of a thermosetting resin which is provided in the case to secure the primary coil and the secondary coil in the case; wherein the stopper prevents the insulator, which has not yet been thermally cured, from flowing between the core and the partition when it is charged into the case. Accordingly, an insulator which has a considerably different thermal expansion coefficient from that of the core is not present between the core and the secondary bobbin. This permits the prevention of problems including the occurrence of cracks in the insulator and/or the secondary bobbin, and the distortion of the core attributable to heat stress, so that higher reliability can be achieved. In addition, the dielectric breakdown of the secondary bobbin due to the corona discharge between the core and the secondary bobbin can be reliably prevented.

In the ignition coil device for an internal-combustion engine, the partition is composed of a very tough elastic material; hence, the occurrence of cracks in the partition can be prevented.

In the ignition coil device for an internal-combustion engine, the bottom surface of the secondary bobbin has an aperture closed with a cover. Hence, both ends of the metal mold for forming the internal surface of the secondary bobbin can be supported at the time of forming the secondary bobbin by injection molding. This enables the metal mold to be securely positioned on the center line of the secondary bobbin, thus making it possible to easily obtain the secondary bobbin having an even wall thickness.

In the ignition coil device for an internal-combustion engine, the cover is provided with a positioning section for positioning the core; hence, an even gap can be reliably obtained between the secondary bobbin and the core.

In the ignition coil device for an internal-combustion engine, the insulator is composed of epoxy resin, thereby making it possible to ensure insulation among the components with an inexpensive material and to secure the components in the case.

In the ignition coil device for an internal-combustion engine, the core is composed of a silicon steel plate, which is a directional electromagnetic steel plate; hence, the excitation efficiency of the core can be increased, permitting high output voltage to be provided with high efficiency.

In the ignition coil device for an internal-combustion engine, there is no need to increase the diameter of the case to prevent the occurrence of cracks in the primary bobbin and the secondary bobbin, the distortion of the core, or other similar problems caused by heat stress. This enables the ignition coil device to be installed in the plug hole of an existing cylinder head.

What is claimed is:

1. A, ignition coil device for an internal-combustion engine, said ignition coil device comprising:

a case;

a core provided in said case;

a primary coil which is provided such that it surrounds said core and which has a primary winding through which a primary current flows, constituted by a conductor wound around a bottomed cylindrical primary bobbin;

a secondary coil which is provided such that it surrounds said primary coil and in which high voltage is generated by the interruption of said primary current;

a stopper provided at the opening of said primary bobbin to close the opening of said primary bobbin; and an insulator composed of a thermosetting resin which is provided in said case to secure said primary coil and said secondary coil in said case;

wherein said stopper prevents said insulator, which has not yet been thermally cured, from flowing between said core and said primary bobbin when it is charged into said case, wherein an insulative elastic member is provided between the core and the primary bobbin.

2. An ignition coil device for an internal-combustion engine, said ignition coil device comprising:

a case;

a core provided in said case;

a primary coil which is provided such that it surrounds said core and which has a primary winding through which a primary current flows, constituted by a conductor wound around a bottomed cylindrical primary bobbin;

a secondary coil which is provided such that it surrounds said primary coil and in which high voltage is generated by the interruption of said primary current; and an insulative elastic member provided between said core and said primary bobbin.

3. An ignition coil device for an internal-combustion engine according to claim 1, wherein the bottom surface of the primary bobbin has an aperture closed with a cover.

4. An ignition coil device for an internal-combustion engine according to claim 3, wherein the cover is provided with a positioning section for positioning the core.

5. An ignition coil device for an internal-combustion engine according to claim 1, wherein cross sections of the core and the primary bobbin obtained by cutting them perpendicularly to the axis of the core have similar shapes.

6. An ignition coil device for an internal-combustion engine, said ignition coil device comprising:

a case;

a core provided in said case;

a primary coil which is provided such that it surrounds said core and which has a primary winding through which a primary current flows;

a secondary coil which is provided between said primary coil and said core such that it surrounds said core and which has a secondary winding composed of a conductor wound around a bottomed cylindrical secondary bobbin, high voltage being generated in the secondary winding by the interruption of said primary current;

a stopper provided at the opening of said secondary bobbin to close the opening of said secondary bobbin; and an insulator composed of a thermosetting resin which is provided in said case to secure said primary coil and said secondary coil in said case;

wherein said stopper prevents said insulator, which has not yet been thermally cured, from flowing between said core and said secondary bobbin when it is charged into said case, wherein there is an insulative elastic member between the core and the secondary bobbin.

7. An ignition coil device for an internal-combustion, said ignition coil device comprising:

a case;

a core provided in said case;

a primary coil which is provided such that it surrounds said core and which has a primary winding through which a primary current flows;

a secondary coil which is provided between said primary coil and said core such that it surrounds said core and which has a secondary winding composed of a conductor wound around a bottomed cylindrical secondary bobbin, high voltage being generated in said secondary winding by the interruption of said primary current; and an insulative elastic member provided between said core and said secondary bobbin.

8. An ignition coil device for an internal-combustion engine according to claim 6, wherein the cross sections of the core and the secondary bobbin obtained by cutting them perpendicularly to the axis of the core have similar shapes.

9. An ignition coil device for an internal-combustion engine according to claim 1, wherein the stopper is provided with a space for receiving the thermally expanded insulative elastic member.

10. An ignition coil device for an internal-combustion, said ignition coil device comprising:

a case;

a core provided in said case;

a primary coil which is provided such that it surrounds the core and which has a primary winding through which a primary current flows;

a secondary coil which is provided between said primary coil and said core such that it surrounds said core and which has a secondary winding formed of a conductor wound around a bottomed cylindrical secondary bobbin, high voltage being generated in said secondary winding by the interruption of said primary current;

an insulative partition which extends along the axis of said core from the bottom surface of said secondary bobbin and which separates said core and said secondary bobbin;

a stopper provided at the opening of said partition to close the opening; and an insulator composed of a thermosetting resin which is provided in said case to secure said primary coil and said secondary coil in said case;

wherein said stopper prevents said insulator, which has not yet been thermally cured, from flowing between said core and said partition when it is charged into said case.

11. An ignition coil device for an internal-combustion engine according to claim 10, wherein the partition is composed of a very tough material.

12. An ignition coil device for an internal-combustion engine according to claim 6, wherein the bottom surface of the secondary bobbin has an aperture closed with a cover.

13. An ignition coil device for an internal-combustion engine according to claim 12, wherein the cover is provided with a positioning section for positioning the core.

14. An ignition coil device for an internal-combustion engine according to claim 1, wherein the insulator is composed of epoxy resin.

15. An ignition coil device for an internal-combustion engine according to claim 1, wherein the core is composed of a silicon steel plate, which is a directional electromagnetic steel plate.

16. An ignition coil device for an internal-combustion engine according to claim 1, wherein at least a part of each of the case, the core, the primary coil, and the secondary coil is placed in a plug hole accommodating a spark plug.

* * * * *